US009730482B2

(12) United States Patent
Allen et al.

(10) Patent No.: US 9,730,482 B2
(45) Date of Patent: Aug. 15, 2017

(54) SYSTEM AND METHOD FOR AIRBAG DEPLOYMENT AND INFLATION

(71) Applicant: Elwha LLC, Bellevue, WA (US)

(72) Inventors: Paul G. Allen, Mercer Island, WA (US); Philip V. Bayly, St. Louis, MO (US); David L. Brody, St. Louis, MO (US); Jesse R. Cheatham, III, Seattle, WA (US); Richard G. Ellenbogen, Seattle, WA (US); Roderick A. Hyde, Redmond, WA (US); Muriel Y. Ishikawa, Livermore, CA (US); Jordin T. Kare, Seattle, WA (US); Eric C. Leuthardt, St. Louis, MO (US); Nathan P. Myhrvold, Medina, WA (US); Tony S. Pan, Bellevue, WA (US); Robert C. Petroski, Seattle, WA (US); Raul Radovitzky, Bedford, MA (US); Anthony V. Smith, Seattle, WA (US); Elizabeth A. Sweeney, Seattle, WA (US); Clarence T. Tegreene, Mercer Island, WA (US); Nicholas W. Touran, Seattle, WA (US); Lowell L. Wood, Jr., Bellevue, WA (US); Victoria Y. H. Wood, Livermore, CA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 14/549,237

(22) Filed: Nov. 20, 2014

(65) Prior Publication Data

US 2016/0143383 A1 May 26, 2016

(51) Int. Cl.

| | |
|---|---|
| ***A42B 3/04*** | (2006.01) |
| ***G08C 17/02*** | (2006.01) |
| ***A42B 3/00*** | (2006.01) |

(52) U.S. Cl.

CPC ..... *A42B 3/0486* (2013.01); *A42B 3/00* (2013.01); *A42B 3/0406* (2013.01); *G08C 17/02* (2013.01)

(58) Field of Classification Search

CPC ..... A42B 3/0486; A42B 3/122; A42B 3/048; A42B 3/0493; G05B 15/02; G05D 7/06

USPC ..... 2/413, 414

See application file for complete search history.

(56) References Cited

U.S. PATENT DOCUMENTS 3,693,748 A * 9/1972 Jones ..... A42B 3/303 181/20

6,125,478 A * 10/2000 Alaloof ..... A41D 13/018 2/456

6,272,412 B1 * 8/2001 Wu ..... B60R 21/0132 701/45

(Continued)

*Primary Examiner* — Shaun R Hurley
*Assistant Examiner* — Bao-Thieu L Nguyen
(74) *Attorney, Agent, or Firm* — Foley & Lardner LLP

(57) ABSTRACT

A helmet with an airbag assembly coupled to the shell of the helmet. The airbag assembly includes an airbag and an inflation device. The inflation device is configured to at least partially inflate the airbag upon deployment of the airbag assembly. The helmet also includes a processing circuit disposed at least partially within the shell. The processing circuit is configured to receive helmet data regarding a second helmet, transmit deployment data regarding inflation of the airbag assembly, and control operation of the inflation device to inflate the airbag based on the helmet data.

33 Claims, 5 Drawing Sheets

(56) References Cited

U.S. PATENT DOCUMENTS 6,542,077 B2 * 4/2003 Joao ..... B60R 25/018 340/425.5
7,397,363 B2 * 7/2008 Joao ..... B60R 25/102 307/10.2
8,194,101 B1 * 6/2012 Mann ..... G09G 5/00 345/633
8,235,416 B2 * 8/2012 Breed ..... B60R 21/015 180/273
8,315,617 B2 * 11/2012 Tadayon ..... H04M 3/53 455/418
8,505,670 B2 * 8/2013 Ogawa ..... A41D 13/018 180/274
8,548,768 B2 * 10/2013 Greenwald ..... A61B 5/0002 340/573.1
8,696,422 B1 * 4/2014 Santiago ..... A63B 69/26 273/455
8,700,354 B1 * 4/2014 Bentley ..... A42B 3/046 702/141
8,719,967 B2 * 5/2014 Milsom ..... A42B 3/122 2/411
8,799,672 B1 * 8/2014 Daniel ..... G06F 21/72 455/90.2
8,896,457 B2 * 11/2014 Howard ..... G08B 13/1427 2/425
9,082,277 B2 * 7/2015 Howard ..... G08B 13/1427
9,226,707 B2 * 1/2016 Huang ..... A42B 3/0473
9,241,528 B2 * 1/2016 Partlo ..... A42B 3/046
2002/0030589 A1 * 3/2002 Tabata ..... A42B 3/303 340/427
2003/0176959 A1 * 9/2003 Breed ..... B60N 2/0232 701/36
2004/0130442 A1 * 7/2004 Breed ..... B60C 11/24 340/443
2005/0067816 A1 * 3/2005 Buckman ..... A41D 13/018 280/730.1
2005/0125117 A1 * 6/2005 Breed ..... G07C 5/008 701/31.5
2006/0025897 A1 * 2/2006 Shostak ..... B60C 23/005 701/1
2006/0062416 A1 * 3/2006 Wu ..... A42B 3/16 381/376
2006/0074338 A1 * 4/2006 Greenwald ..... A61B 5/0002 600/549
2006/0189852 A1 * 8/2006 Greenwald ..... A61B 5/0002 600/300
2006/0288464 A1 * 12/2006 Warden ..... A41D 13/0506 2/69
2007/0061941 A1 * 3/2007 Makabe ..... A41D 13/018 2/102
2008/0243342 A1 * 10/2008 Breed ..... B60R 21/0132 701/45
2008/0256685 A1 * 10/2008 Lampe ..... A42B 3/068 2/411
2008/0282453 A1 * 11/2008 Alstin ..... A41D 13/018 2/413
2009/0158509 A1 * 6/2009 Ghajar ..... A42B 3/046 2/422
2009/0220921 A1 * 9/2009 Abolfathi ..... A61B 5/0028 433/229
2009/0251298 A1 * 10/2009 Dakers ..... A63B 71/0605 340/323 R
2011/0218757 A1 * 9/2011 Callsen ..... F41H 1/04 702/141
2012/0073035 A1 * 3/2012 Mazzarolo ..... A41D 13/0512 2/461
2012/0077439 A1 * 3/2012 Howard ..... G08B 13/1427 455/41.2
2012/0077440 A1 * 3/2012 Howard ..... G08B 13/1427 455/41.2
2012/0102630 A1 * 5/2012 Anderson ..... A42B 3/0486 2/413
2012/0131718 A1 * 5/2012 Uchida ..... A41D 13/018 2/69
2013/0035827 A1 * 2/2013 Breed ..... B60R 21/0132 701/45
2013/0060168 A1 * 3/2013 Chu ..... A42B 3/046 600/595
2013/0093585 A1 * 4/2013 Ambani ..... A42B 3/0413 340/475
2014/0000011 A1 * 1/2014 Johnson ..... A42B 3/121 2/413
2014/0125450 A1 * 5/2014 Brandolese ..... B60R 21/0132 340/3.1
2014/0159922 A1 * 6/2014 Maliszewski ..... A42B 3/046 340/870.16
2014/0215693 A1 * 8/2014 O'Gara ..... A42B 3/069 2/410
2014/0245529 A1 * 9/2014 Beckman ..... A41D 13/0531 2/468
2014/0364772 A1 * 12/2014 Howard ..... A42B 3/046 600/595
2015/0040296 A1 * 2/2015 Hanson ..... A42B 3/069 2/411
2015/0040685 A1 * 2/2015 Nicholson ..... A61B 5/4064 73/862.51
2015/0101112 A1 * 4/2015 Balbien ..... A41D 13/018 2/465
2015/0157080 A1 * 6/2015 Camarillo ..... A42B 3/122 2/459
2015/0164174 A1 * 6/2015 West ..... A42B 3/069 2/414
2015/0216247 A1 * 8/2015 Price ..... A42B 3/069 2/414
2015/0238143 A1 * 8/2015 Meurer ..... A61B 5/6803 600/595
2015/0242803 A1 * 8/2015 Morby ..... G06Q 10/20 705/28
2015/0245680 A1 * 9/2015 Partlo ..... A42B 3/0473 2/411
2015/0314745 A1 * 11/2015 Kepley ..... B60R 21/0132 701/45
2016/0015109 A1 * 1/2016 Anwar ..... H04N 7/181 348/78
2016/0040743 A1 * 2/2016 Staton ..... F16F 13/005 2/412
2016/0057511 A1 * 2/2016 Mullins ..... H04Q 9/00 340/870.07
2016/0058093 A1 * 3/2016 Kennard ..... A42B 3/06 2/411

* cited by examiner

SYSTEM AND METHOD FOR AIRBAG DEPLOYMENT AND INFLATION

BACKGROUND

Various systems are used in applications, such as sports, motor vehicle operation, and the like, to help reduce injuries. For example, football players typically wear a football helmet and shoulder pads to minimize the risk of injury (e.g., due to collisions with other players, the ground, etc.) while playing. Similarly, motor vehicle operators such as motorcyclists often wear helmets to minimize the risk of injury (e.g., due to collisions with other motor vehicles, etc.) while driving.

SUMMARY

One embodiment relates to a helmet including a shell; an airbag assembly coupled to the shell and including an airbag and an inflation device, wherein the inflation device is configured to at least partially inflate the airbag; and a processing circuit disposed at least partially within the shell and configured to receive helmet data regarding a second helmet; transmit deployment data regarding inflation of the airbag assembly; and control operation of the inflation device to inflate the airbag based on the helmet data.

Another embodiment relates to an airbag deployment system including a server including a processor and memory, the server configured to receive first data regarding a first helmet worn by a first user, the first helmet coupled to a first airbag; receive second data regarding a second helmet worn by a second user, the second helmet coupled to a second airbag; determine impact data based on the first data and the second data; and communicate deployment instructions regarding inflation of at least one of the first airbag and the second airbag based on the impact data.

Another embodiment relates to an airbag deployment system including a first helmet including a first processing circuit and a first airbag assembly, the first airbag assembly including a first inflation device and a first airbag; a second helmet including a second processing circuit and a second airbag assembly, the second airbag assembly including a second inflation device and a second airbag; wherein the first processing circuit is configured to communicate impact data regarding a potential impact to the second processing circuit.

Another embodiment relates to a method of using a helmet including receiving first data regarding a first helmet worn by a first user, the first helmet coupled to a first airbag; receiving second data regarding a second helmet worn by a second user; determining impact data based on the first data and the second data; and communicating deployment instructions regarding inflation of at least one of the first airbag and the second airbag based on the impact data.

Another embodiment relates to a method of using an airbag deployment system including transmitting impact data from a first helmet to a second helmet, the first helmet including a first airbag and the second helmet including a second airbag; and selectively inflating at least one of the first airbag and the second airbag based on the impact data.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
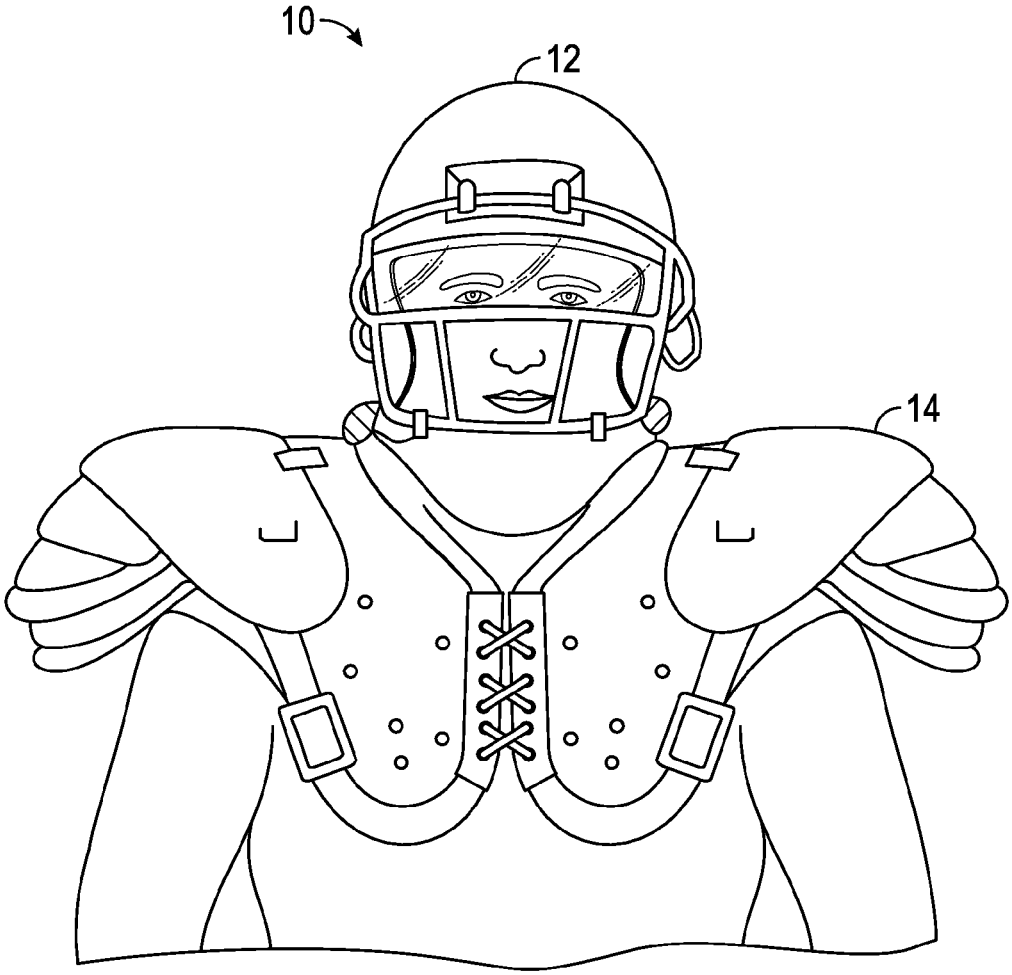
FIG. 1 is a front view of a helmet and torso protection assembly worn by the user, according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to airbag deployment systems for users such as athletes, motor vehicle operators, and the like. The airbag deployment system generally includes a helmet (e.g., a "smart" helmet, a head protection assembly such as a football helmet, hockey helmet, motorcycle helmet, motocross helmet, etc.). Upon detection of an impending impact, the helmet may inflate intelligently to minimize forces and torques on its wearer. In some embodiments, the helmet may communicate with one or more other helmets to determine a course of action regarding inflation of each helmet in an impending impact to, among other things, minimize accelerations experienced by the head and neck portions of the user and reduce the risk of the user experiencing a concussion or other undesirable injuries.

Referring now to FIG. 1, airbag deployment system 10 is shown according to one embodiment. System 10 is usable to reduce the risk of injury to users while performing various activities, including playing sports (e.g., football, hockey, etc.) and operating motor vehicles (e.g., motorcycles, snowmobiles, all-terrain-vehicles (ATVs), etc.). As shown in FIG. 1, system 10 includes helmet 12 (e.g., a head protection device or member, a first or upper protection device or member, etc.) and torso protection assembly 14 (e.g., a shoulder pad assembly, a second or lower protection device or assembly, etc.). In other embodiments, the torso protection assembly 14 may not be included. As discussed in greater detail herein, system 10 is configured to reduce impact forces to a user of helmet 12 in cases of impacts or collisions to the user (e.g., such as collisions between players during a sporting activity, collisions between a motor vehicle operator and other motor vehicles or operators, etc.).

Figure 2:
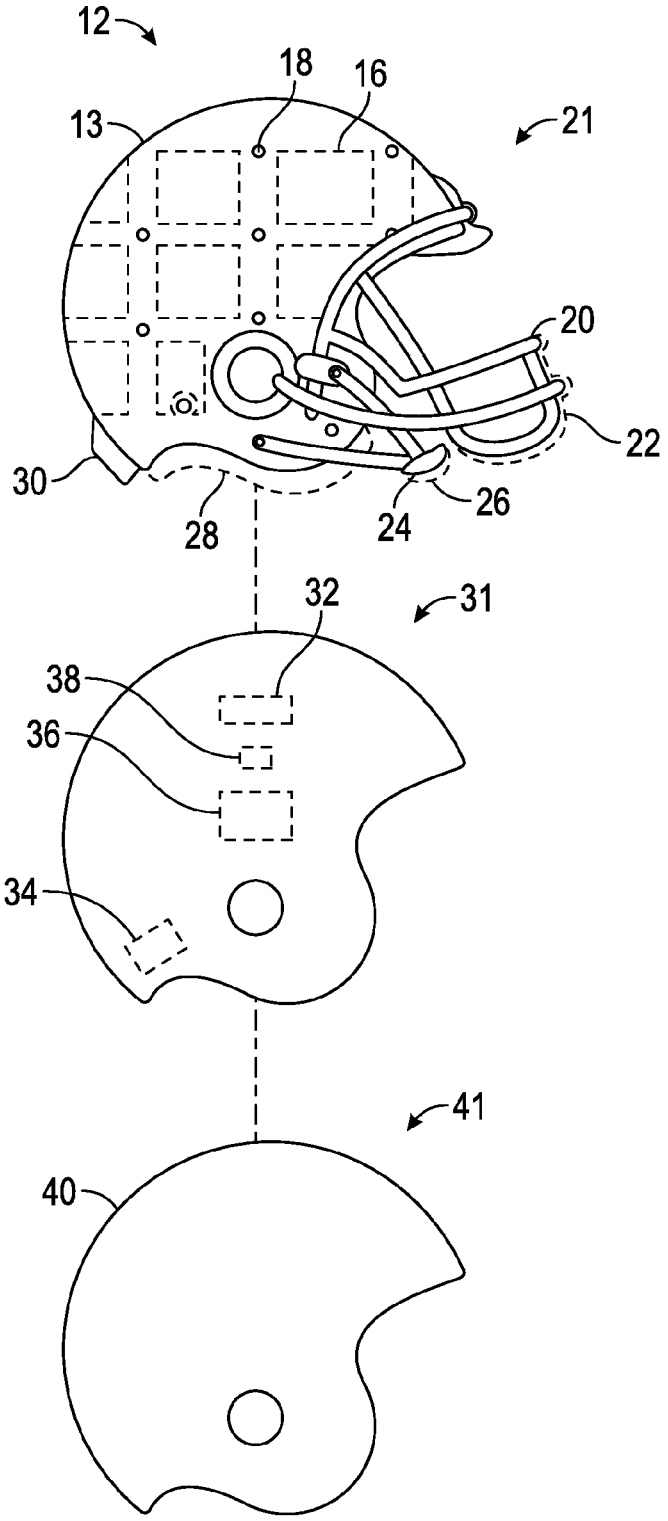
FIG. 2 is an exploded view of a helmet configuration of the helmet of FIG. 1 according to one embodiment.

Referring to FIG. 2, an exploded view of helmet 12 is shown according to one embodiment. In the example embodiment, helmet 12 is a football helmet. In other embodiments, helmet 12 may be any helmet used to protect a user from impacts to the head (e.g., during activities such as motocross, snowboarding, hockey, lacrosse, snowmobiling, etc.). In one embodiment, helmet 12 includes outer shell layer 21, processing circuit layer 31, and padding layer 41. Outer shell layer 21 includes helmet shell 13, helmet airbag array 16, sensor array 18, facemask 20, facemask airbag 22, chin strap 24, chinstrap airbag 26, neck airbag 28, and inflation device cartridge 30. Helmet shell 13 may be structured as any type of helmet shell (e.g., football, baseball, hockey, motocross, etc.) used to protect a user's head. Airbag array 16, facemask airbag 22, chin strap airbag 26, and neck airbag 28 collectively form an airbag assembly for helmet 12. Airbags 16, 22, 26, and 28 may be disposed on the surface of helmet shell 13, internal to helmet shell 13, and/or located at any other location on or within helmet 12 to reduce an impact to a user's head, face, chin, or neck. Sensor array 18 may be one or more devices configured to measure at least one of an expected time until an impact, a speed of an impacting body, the size of an impacting body, a distance between impacting bodies or other characteristic to define expected impact parameters. In other embodiments, sensor array 18 is configured to measure at least one of a force, a torque, and an acceleration (e.g., of the helmet, of an approaching object or person, relative acceleration(s), etc.) to define impact parameters of an actual impact. In one embodiment, sensor array 18 is distributed about a portion of helmet shell 13, facemask 20, and/or chin strap 24. In one embodiment, sensor array 18 may be implemented as a micropower impulse radar (MIR), a Doppler ultrasound, or any other sensor(s) capable of determining the above mentioned characteristics. In some embodiments, sensor array includes different types of sensors, such as a first sensor type and a second sensor type. The first sensor may be a more general, less sophisticated sensor that requires a relatively lower amount of power. The second sensor may be a more specific, more sophisticated sensor that requires a relatively higher amount of power. As such, under normal conditions, only the first sensor may be used. If a collision becomes likely based on data from the first sensor(s), the second sensor(s) may be triggered to provide more precise data.

Still referring to FIG. 2, facemask 20 may be any type of helmet facemask to protect the user's face. In some embodiments, facemask 20 may include one or more crossbars, a transparent shield, or other protection devices. In yet further embodiments, facemask 20 may be rigidly attached to helmet shell 13, forming a single continuous unitary outer shell (e.g., a motocross helmet, etc.), or removably attached (i.e., detachable) to helmet shell 13 (e.g., a hockey helmet, a football helmet, etc.). In yet further embodiments, facemask 20 is omitted (e.g., a baseball helmet, etc.). Facemask airbag 22 is structured to protect the users face and reduce the impact force to the facemask 20 during a collision or impact. Chin strap 24 may be any type of helmet chin strap configured to secure helmet 12 to the user's head (e.g., by extending under or near the chin, on a portion of the neck, etc.), including a football helmet chin strap and the like. Chin strap airbag 26 is structured to protect the chin and front part of the neck (i.e., throat) of a user during an impact. Chinstrap airbag 26 may be disposed on the outer surface of chinstrap 24 or internal to chinstrap 24 (e.g., projecting from chinstrap 24 like that of an automobile steering wheel airbag during a collision). Neck airbag 28 is structured to inflate along the posterior and side portions of the user's neck from the underside of helmet 12. In some embodiments, neck airbag 28 may couple to torso protection assembly 14 via a coupling mechanism to resist relative movement between helmet 12 and torso protection assembly 14 in order to further reduce risk of injury to the user of system 10. In other embodiments, the inflated neck airbag may rest on the collarbone or shoulders of the user. In further embodiments, neck airbag 28 may inflate to take the shape of neck brace (e.g., neck collar or neck pillow). In alternate embodiments, any one of helmet airbag array 16, facemask airbag 22, chinstrap airbag 26, and neck airbag 28 may or may not be included with helmet 12. Inflation device cartridge 30 is structured to store chemicals which when released chemically react to produce gas, and/or compressed gas to be used to inflate one or more airbags of airbag assembly 60 (see FIG. 3). Airbag assembly 60 includes airbags 16, 22, 26, and 28 and inflation device 34, which is described more fully herein.

Processing circuit layer 31 includes communication device 32, inflation device 34, processor 36, and memory 38. In the example embodiment, processing circuit layer 31 is shown as its own layer within helmet 12 between outer shell layer 21 and padding layer 41. In other embodiments, processing circuit layer 31 and its respective components may be included in outer shell layer 21, padding layer 41, or another location of helmet 12. Processing circuit layer 31 is shown as its own layer for clarity and for illustrative purposes only. Inflation device 34 may be implemented to inflate one or more helmet airbags by means of a chemical reaction to produce gas, or alternatively, may release compressed gas from inflation device cartridge 30. Inflation device cartridge 30 may be structured as an interchangeable cartridge which may be replaced when fully depleted. In one embodiment, cartridge 30 may carry five gas generators. When all five gas generators have been used for airbag inflations, cartridge 30 may be removed and a new cartridge 30 may be inserted into helmet 12. In other embodiments, the number of gas generators may be less than or greater than five. In further embodiments, cartridge 30 is not removable from helmet 12, and serves as a fixed reservoir within helmet 12 that is refillable with compressed gas or other materials via a nozzle mechanism attached to helmet 12.

Processor 36 may be implemented as a general-purpose processor, an application specific integrated circuit (ASIC), one or more field programmable gate arrays (FPGAs), a digital-signal-processor (DSP), a group of processing components, or other suitable electronic processing components. Memory 38 is one or more devices (e.g., random access memory (RAM), read-only memory (ROM), Flash Memory, hard disk storage, etc.) for storing data and/or computer code for facilitating the various processes described herein. Memory 38 may be or include non-transient volatile memory or non-volatile memory. Memory 38 may include database components, object code components, script components, or any other type of information structure for supporting the various activities and information structures described herein. Memory 38 may be communicably connected to processor 36 and provide computer code or instructions to processor 36 for executing the processes described herein.

Communication device 32 may be implemented as any type of hardware device capable of transmitting and/or receiving an analog or digital signals, preferably using wireless technology. Communication device 32 may utilize technologies such as Wi-Fi, Bluetooth, radio frequency (RF), infrared (IR), or another suitable wireless communication protocol. Padding layer 41 includes helmet padding 40 which may be any type of helmet padding for added head protection to the user (e.g., foam padding, inflatable pads, etc.). In other embodiments, padding layer 41 may also serve the purpose of housing at least one of the components shown in processing circuit layer 31.

Figure 3:
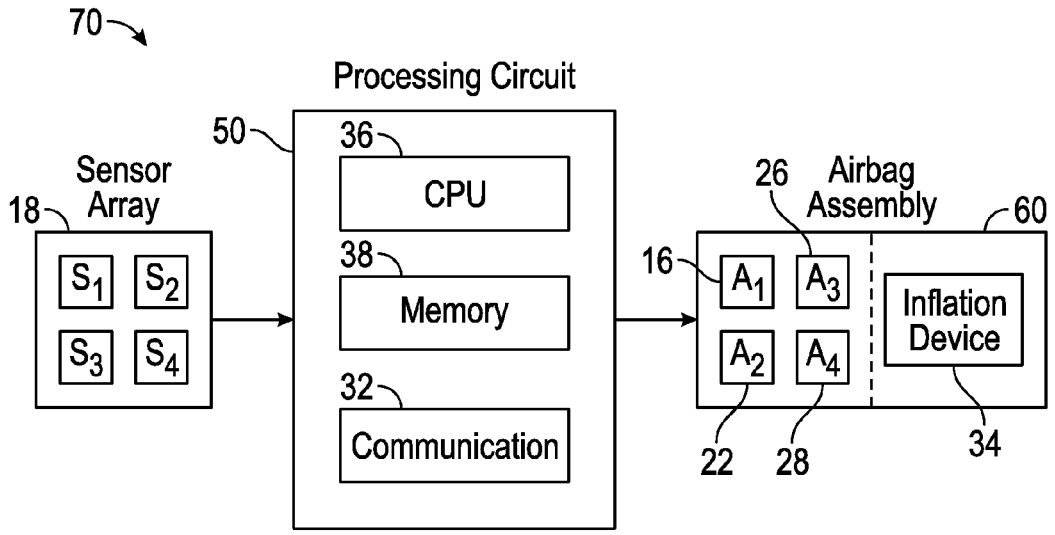
FIG. 3 is a control system for the helmet of FIG. 2 according to one embodiment.

Referring now to FIG. 3, control system 70 for controlling operation of helmet 12 is shown according to one embodiment. Control system 70 includes sensor array 18, processing circuit 50, and airbag assembly 60. Sensor array 18 may be one or more devices (e.g., sensors, micropower impulse radar, etc.) that acquire expected impact data and actual impact data that may then be relayed to processing circuit 50.

Processing circuit 50 includes communication device 32, processor 36, and memory 38. Processing circuit 50 is configured to control operation of airbag assembly 60. In one embodiment, processing circuit 50 controls operation of airbag assembly 60 based on sensor data from sensor array 18 and/or other inputs and data. For example, in some embodiments, stored data in memory 38 and measured data from sensor array 18 may be compared to determine if a threshold (e.g., a user defined impact parameter, etc.) has been reached. If so, processor 36 controls the deployment of airbag assembly 60 via inflation device 34. In other embodiments, communication device 32 may communicate with communication devices in other helmets to determine a plan (e.g., sequence, etc.) for the inflation of the airbags associated with each helmet. In further embodiments, communication device 32 may communicate with an external system or server. The server may determine a deployment sequence for the helmet or helmets in communication with it (e.g., when and which airbags to inflate for each helmet, etc.). In one embodiment, processing circuit 50 is configured to store data regarding past impacts, including forces, torques, etc. experienced by a user, in addition to airbag inflation details regarding which airbag(s) were inflated, inflation timing and pressure, etc. In some embodiments, processing circuit 50 is configured to generate a computer model to predict impacts between users, between a user and an inanimate object (e.g., the ground, etc.), and the like. In one embodiment, processing circuit 50 uses various data regarding users (e.g., height, weight, head shape, head-to-helmet coupling data, kinematic data, etc.) to predict impacts and resulting forces, torques, etc. on users using the computer model. The computer model may be used to provide deployment instructions to users, to calibrate helmet airbag assemblies, and the like. As such, the computer modeling may be done in real time, or in advance of a game, etc.

Figure 4:
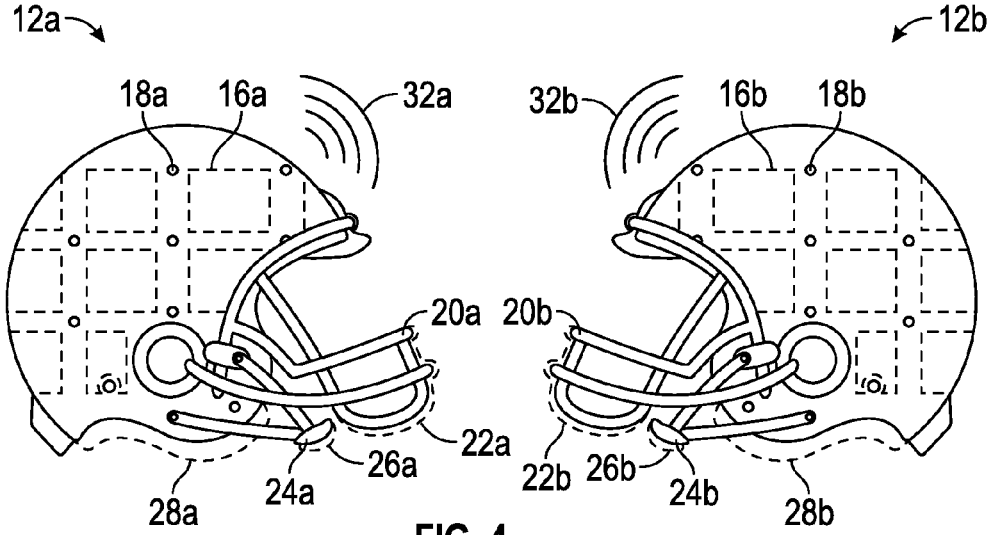
FIG. 4 is an illustration of a first helmet and a second helmet equipped with communication capabilities, according to one embodiment
Figure 5:
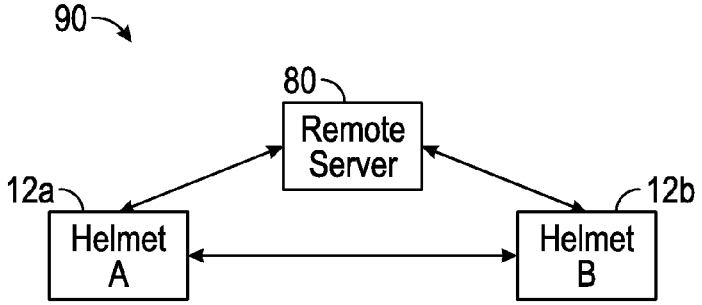
FIG. 5 is a schematic diagram of communication between a remoter server, a first helmet, and a second helmet, according to one embodiment.
Figure 6:
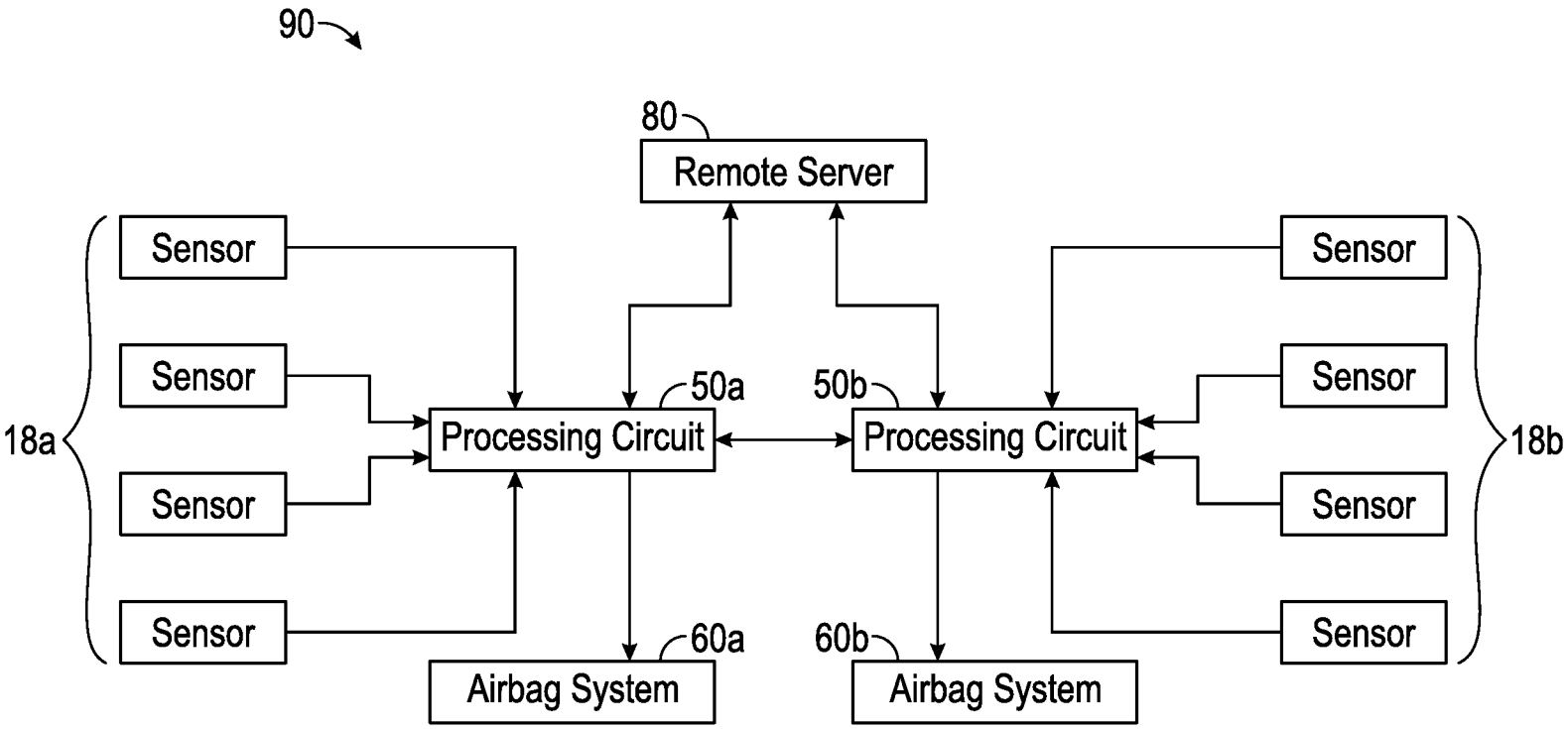
FIG. 6 is a schematic diagram of the communication between the remoter server, first helmet, and second helmet of FIG. 5 according to one embodiment.

Referring to FIGS. 4-6, methods of communication used in determining the deployment of the airbags within helmet 12 are shown. Utilizing communication methods disclosed herein, inflation decisions for airbags worn by one or more separate users may be coordinated. As an overview, first helmet 12*a* may predict an impending impact with an object (e.g., another helmet, the ground, etc.) via impact data gathered with sensor array 18*a*. The data may include user data for a user of the second helmet (e.g., user identification, user weight, and user height), a location of the second helmet (e.g., at least one of two-dimensional location data and three-dimensional location data), a direction of travel of the second helmet, a velocity of the second helmet, and/or an acceleration of the second helmet. The location data may include a relative location (e.g., relative to the first helmet), the velocity data may include a relative velocity, and the acceleration data may include a relative acceleration. Processing circuit 50*a* may utilize the impact data gathered via sensor array 18*a* to determine whether an airbag should be inflated to minimize forces and torques on the user. The inflation of the airbags may be done intelligently by controlling which airbags are inflated and their pressure, size, and shape. Processing circuit 50*a* may also control the operation of inflation device 34*a* to control at least one of an inflation rate and timing of inflation of the airbag assembly 60*a*.

Without communication between helmets, two helmets may individually inflate airbags to different shapes, pressures, and sizes, which may cause the users to experience even greater forces and/or torques. As such, in some embodiments both of two helmets communicate data via helmet-to-helmet communications or via a remote server before a collision, coordinating inflation decisions and establishing a common plan for the inflation of each helmet's airbags. The general overview is described in regards to the first helmet gathering data about the second helmet. In other embodiments, the second helmet may likewise gather data about the first helmet. Furthermore, either the first or second helmet may receive data from or transmit data to a number of other helmets (e.g., in the case of a multi-person collision, etc.).

Referring to FIG. 4, first helmet 12*a* and second helmet 12*b* are shown equipped with the various airbags mentioned above, sensors, and communication capabilities. Helmet 12*a* may gather impact data on an impending impact with an object (e.g., helmet 12*b*) via sensor array 18*a*. Helmets 12*a* and 12*b* may communicate with each other via communication devices 32*a* and 32*b*. In one embodiment, through the communication devices, helmet 12*a* may provide deployment data to helmet 12*b* (e.g., which, if any, airbags helmet 12*a* has already inflated and to what pressure, shape, and size, which, if any, airbags helmet 12*a* is going to inflate and to what pressure, shape, and size) or vice versa. The deployment data may include at least one of timing data regarding a timing of inflation of an airbag, location data for the airbag, and directional data regarding a direction of inflation for the airbag. With the deployment data, helmet 12*b* determines which airbag(s) to inflate, if any, when to inflate the airbag(s), and to what pressure, size, and shape. For example, if helmet 12*a* senses that the crown (i.e., top) of helmet 12*b* is about to collide with the upper neck and jaw of the user (i.e., facemask 20*a* and chin strap 24*a*), helmet 12*a* may indicate to helmet 12*b* that helmet 12*a* is going to inflate facemask airbag 22*a*, chin strap airbag 26*a*, and neck airbag 28*a* (e.g., via a first inflation device controlled by a first processor). Continuing the example, since the crown of helmet 12*b* is going to be the part of helmet 12*b* making contact, the airbags of helmet airbag array 16*b* around the crown of helmet 12*b* may be selectively inflated (e.g., via a second inflation device controlled by a second processor) at the appropriate time and to the appropriate pressure, size, and shape to aid in the reduction of forces and torques to the users' heads and necks.

In another embodiment, helmet 12*a* may command helmet 12*b* to take certain actions (or vice versa). For example, helmet 12*a* may instruct helmet 12*b* to inflate an airbag, not to inflate, which airbags to inflate, when to inflate, and/or to what pressure, size, and shape. Helmet 12*a* may control actions of helmet 12*b* indefinitely, for a limited time span, or only while the two helmets are within a certain distance. In some embodiments, helmet 12*a* may issue a clearance to helmet 12*b* to act at its own discretion, e.g., to inflate one or more of its airbags, to not inflate airbags, when to inflate, etc. By commanding helmet 12*b* what to do regarding airbag inflation, helmet 12*a* may in turn determine how, or if, it may inflate its airbags (e.g., which airbags and pressure, shape, and size) to minimize potential risk to users of both helmets. In an additional embodiment, helmet 12*a* may request information from helmet 12*b* regarding inflation of any airbags of helmet 12*b*. With this information, helmet 12*a* may make a coordinated airbag inflation with helmet 12*b*. In an even further embodiment, helmet 12*a* may control inflation of its airbags based on planned, already-occurred, or ongoing inflation of airbag(s) of helmet 12*b*. For example, helmet 12*b* may have already inflated one or more of its airbags based on a previous or current collision. For example, an offensive football player running with a football may be hit by a first defender, causing one or more airbags to be inflated. Before the play is over, a second defender may come to aid the first defender. Therefore, the helmet of the second defender may communicate with the helmets of the offensive player and first defender to control its airbag inflation based on the already inflated airbags. In any of the above disclosed embodiments, the number of helmets that may communicate with one another may be two or more helmets.

Referring now to FIGS. 5 and 6, the communication between a remote server, a first helmet, and a second helmet of system 90 are shown. FIG. 5 shows two helmets communicating with one another and the remote server; however, any number of helmets may be included in system 90. Referring to FIG. 5, helmets 12*a* and 12*b* (from FIG. 4) are shown to be in communication with one another as well as in communication with an external system, shown as remote server 80. Remote server 80 may be a device such as a global camera or sensor system that monitors all of the helmets within system 90 and makes coordinated decisions, via a processor and memory, as to which airbags to inflate.

FIG. 6 shows a more detailed representation of system 90 shown in FIG. 5. In one embodiment, helmet 12*a* and helmet 12*b* may use their respective sensor arrays 18*a* and 18*b* to acquire and relay information (e.g., impact data, player characteristics, etc.) to remote server 80. Using the relayed information, remote server 80 may communicate deployment instructions to a least one of helmet 12*a* and helmet 12*b*. For example, remote server 80 may command helmet 12*a* to inflate certain airbags. In this case, processing circuit 50*a* receives the command from remote server 80 via communication device 32*a* and deploys the necessary airbags within airbag assembly 60*a*. Via communication device 32*a*, helmet 12*a* may then communicate with helmet 12*b* to provide helmet 12*b* with deployment data for helmet 12*a* or command helmet 12*b* to perform a certain action, as mentioned above. In other embodiments, remote server 80 may perform all of the communication between the helmets (i.e., no direct helmet-to-helmet communication). For example, in one embodiment, helmet 12*a* and 12*b* do not communicate directly with one another, but remote server 80 commands each processing circuit (e.g., processing circuits 50*a* and 50*b*) to inflate certain airbags within each respective airbag assembly (e.g., airbag assemblies 60*a* and 60*b*) at a specific time and rate, and to a specific pressure, size, and shape. As a result, impact forces and/or accelerations experienced by the head and neck portions of the user may be minimized and the risk of the user experiencing a concussion or other undesirable injuries may be reduced.

Figure 7A:
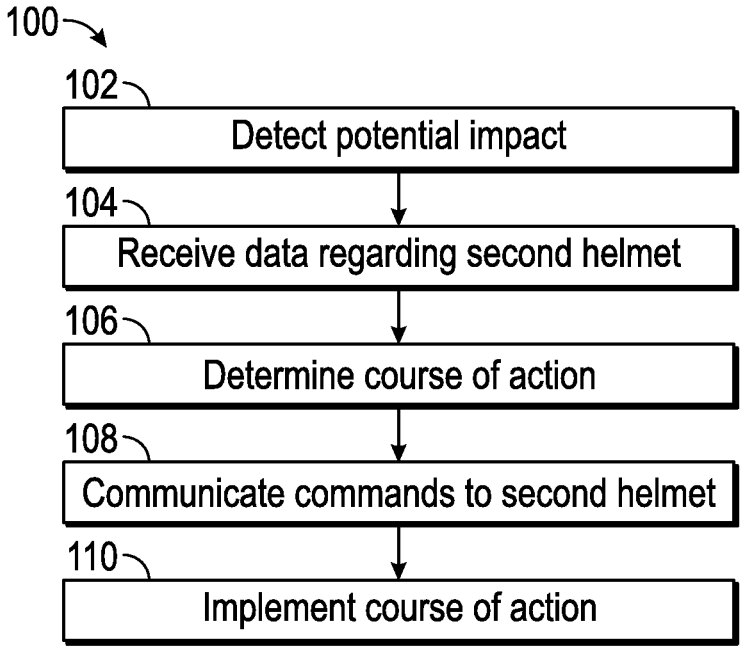
FIG. 7A is a block diagram of a method of communication between a first helmet and a second helmet, according to one embodiment.
Figure 7B:
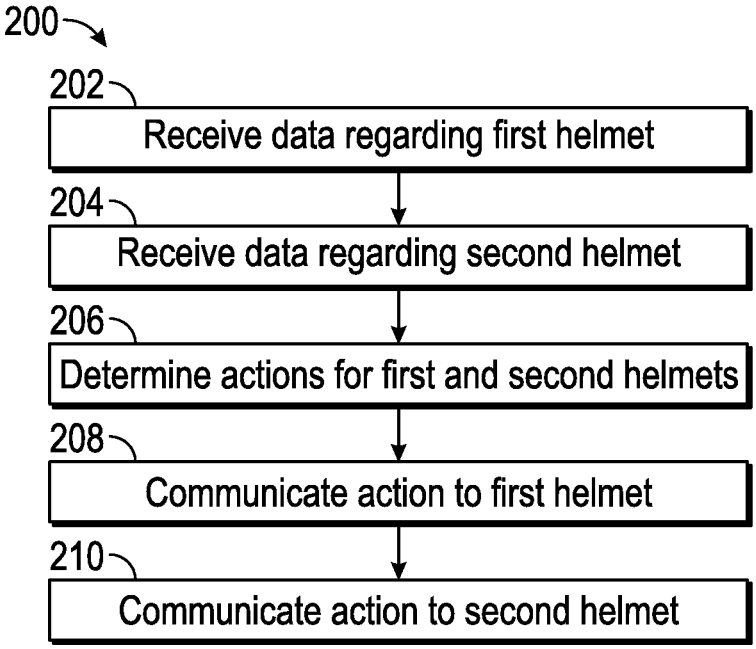
FIG. 7B is a block diagram of a method of communication between a remote server and a first and second helmet, according to one embodiment.

Referring to FIGS. 7A and 7B, two methods of airbag deployment are shown. Referring now to FIG. 7A, method 100 of communication between a first helmet and a second helmet is shown according to an example embodiment. In one example embodiment, method 100 may be implemented with the helmets of FIG. 4. Accordingly, method 100 may be described in regard to FIG. 4.

At 102, the first helmet (e.g., helmet 12*a*) detects a potential impact. For example, when an athlete in football is running with the ball, the athlete's helmet may continually scan the field for potential impacts from other players, the ground, etc. via sensor array 18*a*. At 104, the first helmet receives data regarding a second helmet, such as helmet 12*b*, and a potential impact. For example, sensor array 18*a* is configured to measure at least one of an expected time until an impact, a speed of an impacting body, the size of an impacting body, and a distance between impacting bodies to define expected impact parameters. In one embodiment, each helmet may have a radio-frequency identification (RFID) tag embedded within the helmet to identify the user of each helmet. The identification may allow the first helmet to obtain information such as the second user's height, weight, team, or any other pertinent characteristics. In some embodiments, additional data regarding the user may be provided and include a user status. In some embodiments, a user status includes one or more a medical status, history, or risk of a user, historical data regarding previous collisions involving the user (e.g., during a specified time, during a current game, etc.), and the like. In one embodiment, the user status includes a risk ranking (e.g., level 1, level 2, etc.) such that airbag deployment may be based on the risk ranking In further embodiments, the user status may include a user sensitivity setting. For example, the sensitivity setting may be customized for each user, and may include one or more thresholds (including any thresholds disclosed herein) for deploying/inflating airbags. The setting may range from relatively conservative (e.g., to provide more warnings, etc.) to relatively aggressive (e.g., to provide less warning, etc.). In various alternative embodiments, the setting (or other user data) may be adjustable by a user and/or a remote device.

Following receiving the data regarding the second helmet, the first helmet determines a course of action via processing circuit 50*a* (106). For example, the first helmet may decide to: (i) provide data to the second helmet regarding already-occurred, ongoing, or planned inflation of an airbag of the first helmet, (ii) command actions of the second helmet, (iii) request information from the second helmet regarding its determined course of action, and/or (iv) control deployment based on planned, ongoing, or already-occurred inflation of airbags from the second helmet. At 108, the first helmet communicates the determined course of action to the second helmet via communication device 32*a*. At 110, the first and second helmets implement the determined course of action. For example, the first and second helmets may execute the determined common course of action or sequence for inflation, such as which (if any) airbags to inflate, when to inflate the airbags, and to what pressure, size, and shape. By doing so, the helmets may reduce the magnitude of the impact between the two bodies, reducing forces and torques to the users' necks and heads. Ultimately, this reduces the risk of serious head and neck injuries (e.g., concussions, etc.).

Method 100 is shown to encompass two helmets. In other embodiments, method 100 may involve a plurality of helmets which communicate with one another to make coordinated decisions with regards to airbag inflation (e.g., when three or more users of helmets, like helmet 12, impact each other concurrently). In further embodiments, method 100 may only involve a single helmet and potential impacts with the ground or other objects (e.g., walls, posts, trees, etc.). Also, method 100 is shown from the perspective of the first helmet. In other embodiments, method 100 may be at least one of implemented by the second helmet and jointly implemented by the first and second helmet.

Referring now to FIG. 7B, method 200 of communication between a remote server and first and second helmets is shown according to an example embodiment. In one example embodiment, method 200 may be implemented with the helmets of FIG. 5. Accordingly, method 200 may be described in regard to FIGS. 5 and 6.

In an example embodiment, communication between a remote server, such as remote server 80, and first and second helmets, such as helmets 12*a* and 12*b*, is performed via communication devices 32*a* and 32*b*. Remote server 80 receives data regarding the first helmet (202) and the second helmet (204). Data regarding the first and second helmets may be received in parallel, sequentially (as shown), or reverse order from that shown. In one embodiment, remote server 80 may detect a potential impact and gather all impact data unaided by external devices/sensors (e.g., sensor arrays 18*a* and 18*b*). For example, remote server 80 may include a sensor system which is configured to measure at least one of an expected time until an impact between two bodies, the speed of impacting bodies, the size of impacting bodies, and a distance between impacting bodies to define expected impact parameters. Also, each helmet may have a radio-frequency identification (RFID) tag embedded therein to identify the user of the helmet (e.g., height, weight, etc.) to remote server 80. In other embodiments, sensor array 18 of helmet 12 may record data and communicate the data via communication device 32 to remote server 80.

At 206, remote server 80 determines the course of action for the first and second helmet. For example, remote serve 80 may determine which airbags within the first and second airbag assemblies to inflate, when to inflate the airbags, and to what pressure, size, and shape. In one embodiment, remote server 80 may decide that the best course of action is to inflate airbags on only one of the impacting helmets. Once the course of action is determined, remote server 80 communicates the actions to the first helmet (208) and the second helmet (210). For example, remote server 80 may command the first helmet to inflate certain airbags to a specific pressure, size, and shape (via processor 32*a*). Remote server 80 may command the second helmet to also inflate certain airbags to a specific pressure, size, and shape (via processor 32*b*) to appropriately receive the first helmet's airbags. By doing so, the magnitude of the impact between the two bodies may be reduced and injuries to the user's neck and head may be substantially prevented. Remote server 80 may communicate with the first and second helmets in parallel, sequentially (as shown), or in reverse order from that shown.

Method 200 is shown to encompass only two helmets. In other embodiments, method 200 may involve a plurality of helmets which communicate with a remote server to make coordinated decisions with regards to airbag inflation between the plurality of helmets. In further embodiments, method 200 may only involve a single helmet and potential impacts with the ground and/or other objects (e.g., goal posts, trees, walls, etc.). Also, in other embodiments, method 200 may include communication not only between the remote server and the helmets, but helmet to helmet communications.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, erasable programmable read-only memory (EPROM), electrically erasable programmable read-only memory (EEPROM), compact disk read-only memory (CD-ROM) or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A helmet, comprising:

a shell;

a first airbag assembly coupled to the shell and including a first airbag and a first inflation device, wherein the first inflation device is configured to at least partially inflate the first airbag; and a processing circuit disposed at least partially within the shell and configured to:

receive first helmet data regarding the helmet worn by a first user;

receive second helmet data regarding a second helmet worn by a second user, the second helmet including a second airbag assembly having a second airbag and a second inflation device;

determine impact data based on the first helmet data and the second helmet data;

communicate deployment instructions to the first inflation device regarding inflation of the first airbag to control at least one of an inflation rate and an inflation pressure of the first airbag based on the impact data such that the first airbag deploys from a surface of the shell to receive at least one of the second helmet and the second airbag; and communicate deployment instructions regarding inflation of the second airbag.

2. The helmet of claim 1, wherein the second helmet data includes an indication of at least one of user data for a user of the second helmet, a location of the second helmet, a direction of travel of the second helmet, a velocity of the second helmet, and an acceleration of the second helmet.

3. The helmet of claim 2, wherein the user data includes at least one of a user height, a user weight, a user identification, and a user status.

4. The helmet of claim 2, wherein the location of the second helmet includes two-dimensional location data.

5. The helmet of claim 2, wherein the location of the second helmet includes three-dimensional location data.

6. The helmet of claim 2, wherein the location of the second helmet is a relative location, the velocity of the second helmet is a relative velocity, and the acceleration of the second helmet is a relative acceleration.

7. The helmet of claim 1, wherein the second helmet data includes second deployment data for the second airbag of the second helmet.

8. The helmet of claim 7, wherein the second deployment data includes an indication of at least one of whether the second airbag has been inflated, a decision regarding future inflation of the second airbag, and a planned future inflation time for the second airbag.

9. The helmet of claim 7, wherein the second deployment data includes at least one of a size, a shape, a location, an internal pressure, and a direction of inflation for the inflated second airbag.

10. The helmet of claim 1, wherein the first helmet data includes first deployment data that includes timing data regarding a planned future inflation time of the first airbag.

11. The helmet of claim 1, wherein the first helmet data includes first deployment data that includes directional data regarding at least one of a location and a direction of inflation for the first airbag.

12. The helmet of claim 1, wherein the first helmet data includes first deployment data that includes data regarding at least one of a size and a shape for the inflated first airbag.

13. The helmet of claim 1, wherein the processing circuit is configured to transmit a request for the second helmet to not inflate the second airbag.

14. The helmet of claim 1, wherein the processing circuit is configured to transmit a request for the second helmet to inflate the second airbag.

15. The helmet of claim 1, wherein the processing circuit is configured to transmit a request for the second helmet data regarding deployment of the second airbag of the second helmet.

16. A helmet airbag deployment system, comprising:

a processing circuit including a processor and memory, the processing circuit configured to:

be worn by a first user;

receive first data regarding a first helmet worn by the first user, the first helmet coupled to a first airbag;

receive second data regarding a second helmet worn by a second user, the second helmet coupled to a second airbag;

determine impact data based on the first data and the second data;

communicate deployment instructions to an inflation device regarding inflation of the first airbag to control at least one of an inflation rate and an inflation pressure of the first airbag based on the impact data such that the first airbag deploys from a surface of the first helmet to receive at least one of the second helmet and the second airbag; and communicate deployment instructions regarding inflation of the second airbag.

17. The helmet airbag deployment system of claim 16, wherein the processing circuit is a first processing circuit, and further comprising a second processing circuit configured to be worn by the second user and communicate with the first processing circuit.

18. The helmet airbag deployment system of claim 16, wherein the processing circuit is configured to control operation of the inflation device to control a timing of inflation of at least one of the first airbag and the second airbag based on the impact data.

19. The helmet airbag deployment system of claim 16, wherein the first data includes at least one of first deployment data for the first airbag, first user data for the first user of the first helmet, a location of the first helmet, a direction of travel of the first helmet, a velocity of the first helmet, and an acceleration of the first helmet.

20. The helmet airbag deployment system of claim 16, wherein the first data includes an indication of at least one of whether the first airbag has been inflated, a decision regarding future inflation of the first airbag, and a planned future inflation time for the first airbag.

21. The helmet airbag deployment system of claim 16, wherein the first data includes at least one of a size, a shape, a location, an internal pressure, and a direction of inflation for the inflated first airbag.

22. The helmet airbag deployment system of claim 16, wherein the first data includes at least one of a first user height, a first user weight, a first user identification, and a first user status.

23. The helmet airbag deployment system of claim 16, wherein the deployment instructions include at least one of timing data regarding a timing of inflation of at least one of the first airbag and the second airbag and directional data regarding a direction of inflation for the at least one of the first airbag and the second airbag.

24. The helmet airbag deployment system of claim 16, wherein the deployment instructions include at least one of data regarding a location of an inflated airbag, data regarding a size of the inflated airbag, data regarding a shape of the inflated airbag and data regarding an internal pressure of the inflated airbag.

25. An airbag deployment system, comprising:

a first helmet including a first processing circuit and a first airbag assembly, the first airbag assembly including a first inflation device and a first airbag, the first airbag configured to be selectively deployable from at least one of a shell, a facemask, a chinstrap, padding, and an underside of the first helmet; and a second helmet including a second processing circuit and a second airbag assembly, the second airbag assembly including a second inflation device and a second airbag, the second airbag configured to be selectively deployable from at least one of a shell, a facemask, a chinstrap, padding, and an underside of the second helmet such that the second airbag is configured to deploy from a surface of the second helmet to engage at least one of the first helmet and the first airbag during an impact between the first helmet and the second helmet;

wherein the first processing circuit is configured to communicate impact data regarding a potential impact between the first helmet and the second helmet to the second processing circuit; and wherein the first processing circuit is configured to transmit a request for deployment data regarding deployment of the second airbag assembly.

26. The airbag deployment system of claim 25, wherein the first processing circuit is configured to control operation of the first inflation device to control at least one of a size, a shape, a location, and a direction of inflation for the first airbag based on the impact data.

27. The airbag deployment system of claim 25, wherein the second processing circuit is configured to control operation of the second inflation device to control at least one of a size, a shape, a location, and a direction of inflation for the second airbag based on the impact data.

28. The airbag deployment system of claim 25, wherein the impact data includes an indication of at least one of user data for a user of the first helmet, a location of the first helmet, a direction of travel of the first helmet, a velocity of the first helmet, and an acceleration of the first helmet.

29. The airbag deployment system of claim 25, wherein the impact data includes at least one of a user height, a user weight, a user identification, and a user status.

30. The airbag deployment system of claim 28, wherein the location is a relative location of the first helmet in relation to the second helmet, the velocity is a relative velocity of the first helmet in relation to the second helmet, and the acceleration is a relative acceleration of the first helmet in relation to the second helmet.

31. The airbag deployment system of claim 25, wherein the first processing circuit is further configured to communicate deployment data to the second processing circuit, wherein the deployment data includes an indication of at least one of whether the first airbag has been inflated, a decision regarding future inflation of the first airbag, and a planned future inflation time for the first airbag.

32. The airbag deployment system of claim 25, wherein the first processing circuit is further configured to communicate deployment data to the second processing circuit, wherein the deployment data includes at least one of a size, a shape, a location, an internal pressure, and a direction of inflation for the inflated first airbag.

33. An airbag deployment system, comprising:

a first helmet including a first processing circuit and a first airbag assembly, the first airbag assembly including a first inflation device and a first airbag, the first airbag configured to be selectively deployable from at least one of a shell, a facemask, a chinstrap, padding, and an underside of the first helmet; and a second helmet including a second processing circuit and a second airbag assembly, the second airbag assembly including a second inflation device and a second airbag, the second airbag configured to be selectively deployable from at least one of a shell, a facemask, a chinstrap, padding, and an underside of the second helmet such that the second airbag is configured to deploy from a surface of the second helmet to engage at least one of the first helmet and the first airbag during an impact between the first helmet and the second helmet;

wherein the first processing circuit is configured to communicate impact data regarding a potential impact between the first helmet and the second helmet to the second processing circuit; and wherein the first processing circuit is configured to transmit at least one of an instruction to inflate the second airbag, an instruction to not inflate the second airbag, and a clearance to inflate the second airbag to the second processing circuit.

* * * * *